US005828018A

United States Patent [19]

Cooper

[11] Patent Number: 5,828,018

[45] Date of Patent: Oct. 27, 1998

[54] LIGHT SWITCH COVER PLATE WITH MECHANICAL TIMER MECHANISM

[76] Inventor: Edward M. Cooper, 2404 Congressman Hebert, Chalmette, La. 70043

[21] Appl. No.: 837,254

[22] Filed: Mar. 26, 1997

[51] Int. Cl.[6] ..... H01H 43/00

[52] U.S. Cl. ..... 200/33 R; 200/38 E; 307/141

[58] Field of Search ..... 200/33 R, 35 R, 200/38 R, 38 E, 35 H, 33 B, 33 D, 17 R; 307/141; 315/360, 362

[56] References Cited

U.S. PATENT DOCUMENTS

| | | | |
|---|---|---|---|
| 3,979,601 | 9/1976 | Franklin | 307/141 |
| 4,002,925 | 1/1977 | Monahan | 307/141 |
| 4,112,313 | 9/1978 | Kutin | 307/141 |
| 4,164,635 | 8/1979 | Finch et al. | 200/33 R |
| 4,494,012 | 1/1985 | Coker | 307/132 |
| 4,508,943 | 4/1985 | Pfeiffer et al. | 200/17 R |
| 4,794,213 | 12/1988 | Wood | 200/33 R |
| 4,835,413 | 5/1989 | Nilssen | 307/141 |
| 4,912,376 | 3/1990 | Strick | 315/362 |
| 5,306,957 | 4/1994 | Ellingham et al. | 307/141 |
| 5,473,204 | 12/1995 | Temple | 307/141 |

*Primary Examiner*—Michael A. Friedhofer
*Attorney, Agent, or Firm*—Joseph N. Breaux

[57] ABSTRACT

A light switch cover plate with a mechanical timer mechanism that includes a linear rack member for engaging the existing light switch actuator and that includes a cover plate member defining a timer mechanism cavity wherein the linear rack member is slidably installed within the timer mechanism cavity and guided along a predetermined path between a fully upward position and a fully downward position by an upper rack guide and a left and right lower rack guide, the linear rack member being biased toward the fully downward position by a helical spring attached between the linear rack member and the cover plate member, the linear rack having gear teeth formed along a side edge thereof in meshing relationship with a spring loaded mechanical drive mechanism including a spring drive assembly, a spring drive gear, a reduction gear assembly and an anchor escapement gear, the spring loaded mechanical drive mechanism providing a resistance against movement of the linear rack toward the fully downward position under the tensional force of the helical spring in a manner such that a predetermined period of time is required for the linear rack to move from the fully upward position to the fully downward position.

7 Claims, 2 Drawing Sheets

LIGHT SWITCH COVER PLATE WITH MECHANICAL TIMER MECHANISM

TECHNICAL FIELD

The present invention relates to cover plates for electrical switches and more particularly to a cover plate for electrical light switches that includes a mechanical timer mechanism having a linear rack member for engaging the existing light switch actuator and that includes a cover plate member defining a timer mechanism cavity wherein the linear rack member is slidably installed within the timer mechanism cavity and guided along a predetermined path between a fully upward position and a fully downward position by an upper rack guide and a left and right lower rack guide, the linear rack member being biased toward the fully downward position by a helical spring attached between the linear rack member and the cover plate member, the linear rack having gear teeth formed along a side edge thereof in meshing relationship with a spring loaded mechanical drive mechanism including a spring drive assembly, a spring drive gear, a reduction gear assembly and an anchor escapement gear, the spring loaded mechanical drive mechanism providing a resistance against movement of the linear rack toward the fully downward position under the tensional force of the helical spring in a manner such that a predetermined period of time is required for the linear rack to move from the fully upward position to the fully downward position.

BACKGROUND OF THE INVENTION

Conventional light switches include a switch actuator that is flipped on and off to control power to an electrically powered device such as a fan or light fixture. Because these light switches are manually actuated, it is easy to leave the light switch in the on position for unnecessarily long periods of time wasting expensive energy. This is waste is particularly likely to occur in areas where children turn the lights switches on and forget to turn the switch to the off position before leaving the room. It would be a benefit, therefore, to have a mechanism that would move the switch actuator from the on position to the off position after a predetermined period of time. It would be a further benefit if the mechanism was easily installed and inexpensive to manufacture.

SUMMARY OF THE INVENTION

It is thus an object of the invention to provide a light switch cover plate with a mechanical timer mechanism that is positionable in connection with the switch actuator of a conventional light switch and that moves the switch actuator to the off position after a predetermined period of time.

It is a further object of the invention to provide a light switch cover plate with a mechanical timer mechanism that is easily installed in connection with a conventional light switch.

It is a still further object of the invention to provide a light switch cover plate with a mechanical timer mechanism that includes a linear rack member for engaging the existing light switch actuator and that includes a cover plate member defining a timer mechanism cavity wherein the linear rack member is slidably installed within the timer mechanism cavity and guided along a predetermined path between a fully upward position and a fully downward position by an upper rack guide and a left and right lower rack guide, the linear rack member being biased toward the fully downward position by a helical spring attached between the linear rack member and the cover plate member, the linear rack having gear teeth formed along a side edge thereof in meshing relationship with a spring loaded mechanical drive mechanism including a spring drive assembly, a spring drive gear, a reduction gear assembly and an anchor escapement gear, the spring loaded mechanical drive mechanism providing a resistance against movement of the linear rack toward the fully downward position under the tensional force of the helical spring in a manner such that a predetermined period of time is required for the linear rack to move from the fully upward position to the fully downward position.

It is a still further object of the invention to provide a light switch cover plate with mechanical timer mechanism that accomplishes some or all of the above objects in combination.

Accordingly, a light switch cover plate with a mechanical timer mechanism is provided. The light switch cover plate with mechanical timer mechanism includes a linear rack member for engaging the existing light switch actuator and that includes a cover plate member defining a timer mechanism cavity wherein the linear rack member is slidably installed within the timer mechanism cavity and guided along a predetermined path between a fully upward position and a fully downward position by an upper rack guide and a left and right lower rack guide, the linear rack member being biased toward the fully downward position by a helical spring attached between the linear rack member and the cover plate member, the linear rack having gear teeth formed along a side edge thereof in meshing relationship with a spring loaded mechanical drive mechanism including a spring drive assembly, a spring drive gear, a reduction gear assembly and an anchor escapement gear, the spring loaded mechanical drive mechanism providing a resistance against movement of the linear rack toward the fully downward position under the tensional force of the helical spring in a manner such that a predetermined period of time is required for the linear rack to move from the fully upward position to the fully downward position.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
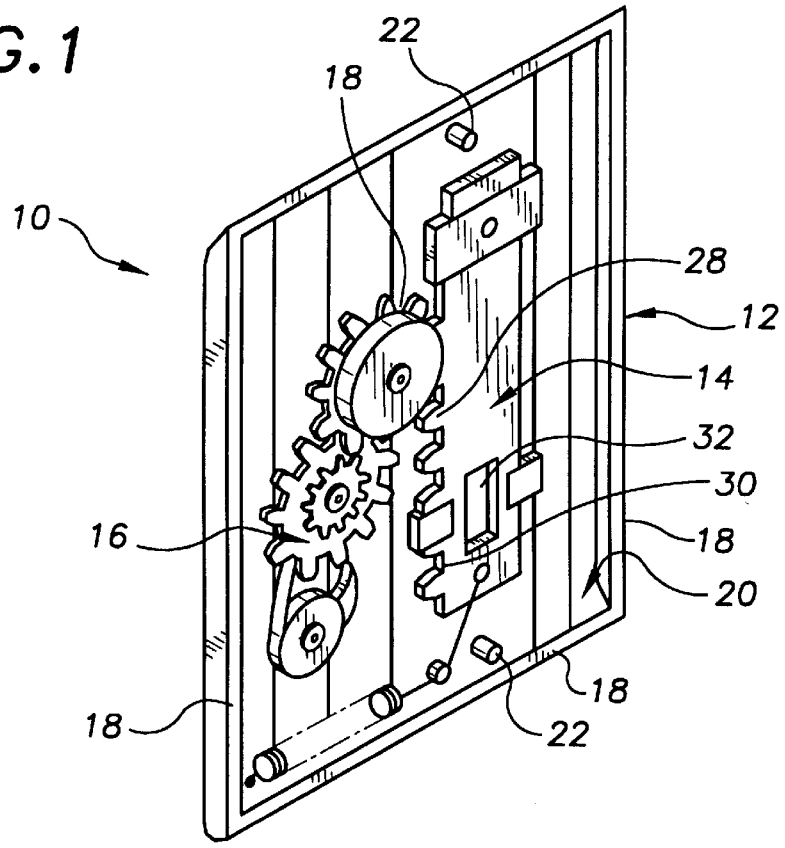
FIG. 1 is a perspective back side view of an exemplary embodiment of the light switch cover plate with mechanical timer mechanism of the present invention showing the switch cover plate member, the timer mechanism cavity, the linear rack in the fully up and locked position, the rack tension spring, the switch opening, the upper rack guide with locking pin hole, the left and right lower rack guides, the rack teeth, and the spring loaded mechanical drive mechanism including the spring drive assembly, the spring drive gear, the reduction gear assembly and the anchor escapement gear.

FIG. 1 shows an exemplary embodiment of the light switch cover plate with mechanical timer mechanism of the present invention, generally designated by the numeral 10. Cover plate with mechanical timer mechanism 10 includes a cover plate member, generally designated 12; a linear rack member, generally designated 14; and a spring loaded mechanical drive mechanism, generally designated 16.

Cover plate member 12 is of molded plastic construction and includes a perimeter edge 18 that defines a timer mechanism cavity 20, a pair of mounting apertures 22 are provided for screw mounting cover plate member 12 in place of an existing conventional electric light switch cover plate. An elongated rectangular cover plate opening 24 (FIG. 3) is formed through cover plate member 12 between a front cover plate surface 26 (FIG. 3) and timer mechanism cavity 20.

Figure 3:
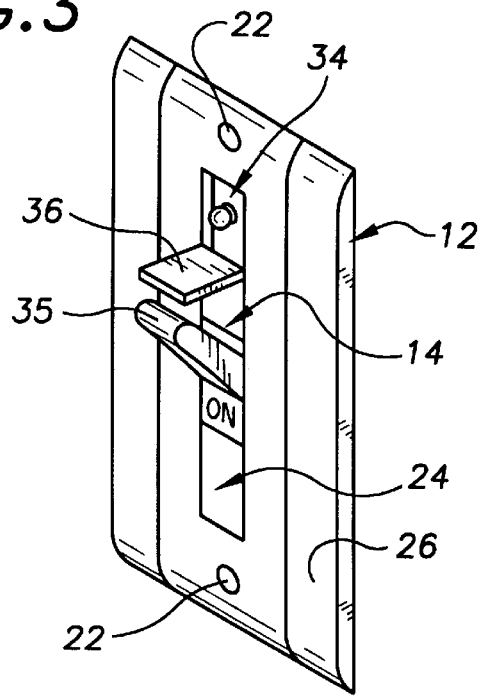
FIG. 3 is a perspective view of the light switch cover plate of FIG. 1 secured in place over an existing conventional light switch with the actuator of the light switch positioned through the switch opening, the switch locking pin assembly extending outwardly from the linear rack, and the optional rack movement tab extending from the linear rack.

Linear rack member 14 is molded from plastic and is substantially rectangular in shape. A number of rack gear teeth 28 are formed into a side edge 30 thereof and a rectangular switch opening 32 is formed therethrough and sized to receive therethrough a switch actuator 35 (FIG. 3) of a light switch. With reference to FIG. 3, a switch locking pin assembly 34 extends outwardly from linear rack 14 through cover plate opening 24 as does an integrally molded rack movement tab 36.

Figure 2:
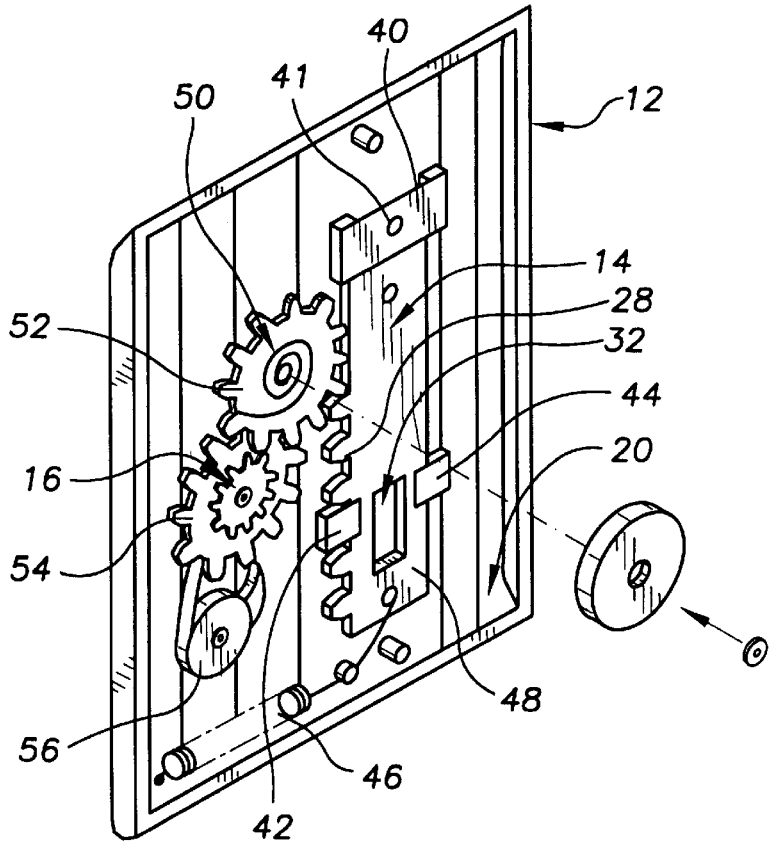
FIG. 2 is a perspective back side view of the light switch cover plate of FIG. 1 with the cover assembly removed from the spring drive assembly revealing the spring and the linear rack in the fully downward position showing the rack locking aperture.

With reference to FIG. 2, linear rack member 14 is slidably installed in connection with cover plate member 12 within timer mechanism cavity 20 and guided along a predetermined path between a fully upward position (illustrated in FIG. 1) and a fully downward position (illustrated in FIG. 2) by an upper rack guide 40 and left and right lower rack guides 42,44. In this embodiment, upper rack guide 40 and left and right lower rack guides 42,44 are integrally formed with cover plate member 12. Upper rack guide 40 is provided with a locking pin hole 41 the purpose of which is discussed herein below in further detail.

Linear rack member 14 is biased toward the fully downward position by a helical spring 46 that is attached between a bottom end 48 of linear rack member 14 and cover plate member 12.

Spring loaded mechanical drive mechanism 16 including a spring drive assembly, generally designated by the numeral 50; a spring drive gear 52, a reduction gear assembly 54 and an anchor escapement gear 56. Spring drive gear 52 is meshed with said rack gear teeth 28. Spring loaded mechanical drive mechanism 16 provides a clockwork escapement resistance against the movement of linear rack 14 toward the fully downward position under the tensional force generated by helical spring 46 in a manner such that a predetermined period of time is required for linear rack 14 to move from the fully upward position to the fully downward position. This provides the timed shutoff of the light switch when switch actuator 35 (FIG. 3) is positioned through switch opening 32.

Figure 4:
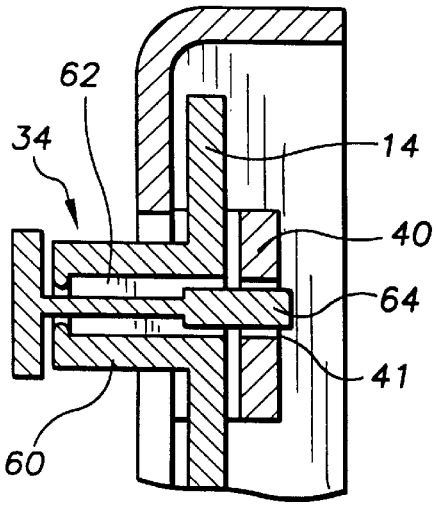
FIG. 4 is a detail sectional view of the upper rack guide with locking pin hole; the linear rack positioned in the fully upward position; and the switch locking pin assembly including the locking assembly flange integrally formed with the linear rack and the moveable locking pin positioned into the locking pin hole of the upper rack guide.
Figure 5:
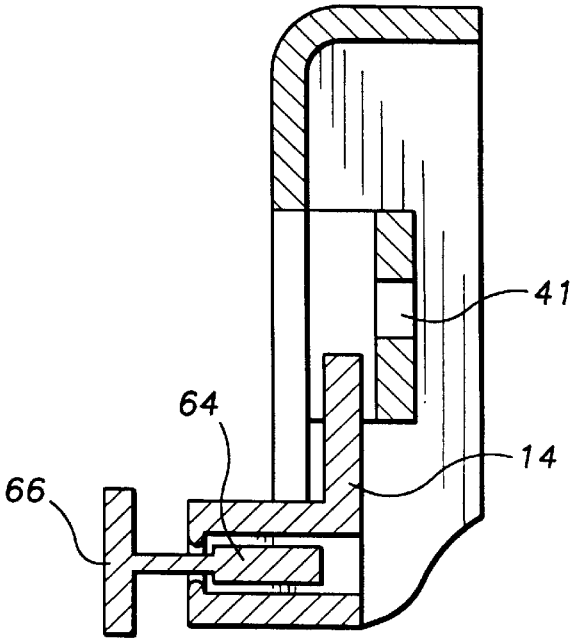
FIG. 5 is a detail sectional view of the upper rack guide with locking pin hole; the linear rack positioned in the fully downward position; and the switch locking pin assembly including the locking assembly flange integrally formed with the linear rack and the moveable locking pin fully withdrawn into the locking pin guide passageway of the locking assembly flange.

With reference to FIG. 4, when no timed shutoff is desired, linear rack 14 can be locked in the fully upward position by switch locking pin assembly 34. In this embodiment switch locking pin assembly 34 includes a locking assembly flange 60 that is integrally formed with linear rack 14 and that is provided with a locking pin passageway 62 within which a moveable locking pin 64 is slidably positioned and moveable into locking pin hole 41 of upper rack guide 40 to lock linear rack 14 in a fully upward position. With reference to FIG. 5, when automatic shut off is desired, a grasping knob 66 attached to moveable locking pin 64 is grasped and pulled until moveable locking pin 64 is withdrawn from locking pin hole 41 allowing linear rail 14 to move toward the fully downward position as described herein before.

It can be seen from the preceding description that a light switch cover plate with a mechanical timer mechanism has been provided that is positionable in connection with the switch actuator of a conventional light switch and that moves the switch actuator to the off position after a predetermined period of time; that is easily installed in connection with a conventional light switch; and that includes a linear rack member for engaging the existing light switch actuator and that includes a cover plate member defining a timer mechanism cavity wherein the linear rack member is slidably installed within the timer mechanism cavity and guided along a predetermined path between a fully upward position and a fully downward position by an upper rack guide and a left and right lower rack guide, the linear rack member being biased toward the fully downward position by a helical spring attached between the linear rack member and the cover plate member, the linear rack having gear teeth formed along a side edge thereof in meshing relationship with a spring loaded mechanical drive mechanism including a spring drive assembly, a spring drive gear, a reduction gear assembly and an anchor escapement gear, the spring loaded mechanical drive mechanism providing a resistance against movement of the linear rack toward the fully downward position under the tensional force of the helical spring in a manner such that a predetermined period of time is required for the linear rack to move from the fully upward position to the fully downward position.

It is noted that the embodiment of the light switch cover plate with mechanical timer mechanism described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A light switch cover plate with mechanical timer mechanism comprising:

a cover plate member defining a timer mechanism cavity and having a cover plate opening formed therethrough between a front cover plate surface and said timer mechanism cavity;

a linear rack member having a switch opening formed therethrough sized to receive therethrough a switch actuator of a light switch and a switch locking pin assembly extending outwardly from said linear rack member through said cover plate opening, said linear rack member being slidably installed within said timer mechanism cavity and guided along a predetermined path between a fully upward position and a fully downward position by an upper rack guide and a left and right lower rack guide, said linear rack member being biased toward said fully downward position by a helical spring attached between said linear rack member and said cover plate member, said linear rack member having rack gear teeth formed along a side edge thereof; and a spring loaded mechanical drive mechanism including a spring drive assembly, a spring drive gear, a reduction gear assembly and an anchor escapement gear, said spring drive gear being in meshing relationship with said rack gear teeth, said spring loaded mechanical drive mechanism providing a resistance against movement of said linear rack member toward said fully downward position under a tensional force of said helical spring in a manner such that a predetermined period of time is required for said linear rack member to move from said fully upward position to said fully downward position.

2. The light switch cover plate with mechanical timer mechanism of claim 1, wherein:

said cover plate member is of molded plastic construction and includes a perimeter edge that defines said timer mechanism cavity.

3. The light switch cover plate with mechanical timer mechanism of claim 1, wherein:

said linear rack member is molded from plastic and has a substantially rectangular shape.

4. The light switch cover plate with mechanical timer mechanism of claim 1 wherein:

said switch locking pin assembly includes a locking assembly flange that is integrally formed with said linear rack member and that is provided with a locking pin passageway within which a moveable locking pin is slidably positioned and moveable into a locking pin hole formed through said upper rack guide to lock said linear rack member in said fully upward position.

5. The light switch cover plate with mechanical timer mechanism of claim 2, wherein:

said linear rack member is molded from plastic and has a substantially rectangular shape.

6. The light switch cover plate with mechanical timer mechanism of claim 2 wherein:

said switch locking pin assembly includes a locking assembly flange that is integrally formed with said linear rack member and that is provided with a locking pin passageway within which a moveable locking pin is slidably positioned and moveable into a locking pin hole formed through said upper rack guide to lock said linear rack member in said fully upward position.

7. The light switch cover plate with mechanical timer mechanism of claim 3 wherein:

a said switch locking pin assembly includes a locking assembly flange that is integrally formed with said linear rack member and that is provided with a locking pin passageway within which a moveable locking pin is slidably positioned and moveable into a locking pin hole formed through said upper rack guide to lock said linear rack member in said fully upward position.

* * * * *